US005947163A

United States Patent [19]

Steiner

[11] Patent Number: 5,947,163

[45] Date of Patent: Sep. 7, 1999

[54] SERIES SHED WEAVING ROTOR WITH STAGGERED BEAT-UP LAMELLA

[75] Inventor: Alois Steiner, Rieden, Switzerland

[73] Assignee: Sulzer Rueti AG, Rueti, Switzerland

[21] Appl. No.: 08/973,833

[22] PCT Filed: Apr. 26, 1996

[86] PCT No.: PCT/CH96/00157

§ 371 Date: Dec. 18, 1997

§ 102(e) Date: Dec. 18, 1997

[87] PCT Pub. No.: WO97/00986

PCT Pub. Date: Jan. 9, 1997

[30] Foreign Application Priority Data

Jun. 29, 1995 [CH] Switzerland ..... 01 824/95-5

[51] Int. Cl.[6] ..... D03D 47/00

[52] U.S. Cl. ..... 139/28

[58] Field of Search ..... 139/28, 11

[56] References Cited

U.S. PATENT DOCUMENTS

| | | | |
|---|---|---|---|
| 4,487,233 | 12/1984 | Steiner | 139/28 |
| 4,498,501 | 2/1985 | Steiner | 139/28 |
| 4,614,209 | 9/1986 | Steiner | 139/11 |
| 5,174,341 | 12/1992 | Steiner et al. | 139/28 |
| 5,188,154 | 2/1993 | Christe et al. | 139/28 |

FOREIGN PATENT DOCUMENTS

| | | |
|---|---|---|
| 0 137 971 A1 | 4/1985 | European Pat. Off. . |
| 0 456 599 A1 | 11/1991 | European Pat. Off. . |

*Primary Examiner*—Andy Falik

*Attorney, Agent, or Firm*—Townsend and Townsend and Crew LLP

[57] ABSTRACT

A weaving rotor of a series shed weaving machine includes a rotating shaft having an axial direction. A plurality of beat-up lamella are arranged on a surface of the weaving rotor, and travel in a direction of rotation of the shaft. The beat-up lamella which are arranged on the weaving rotor to follow one another in the direction of rotation are further arranged so as to be displaced out of alignment in the axial direction of the shaft. The displacement of the beat-up lamella causes weft threads to be beat up uniformly distributed over the width of the cloth to be made so that the cloth is uniform.

4 Claims, 2 Drawing Sheets

SERIES SHED WEAVING ROTOR WITH STAGGERED BEAT-UP LAMELLA

BACKGROUND OF THE INVENTION

The invention relates to a weaving rotor with beat-up lamella in accordance with the preamble of claim 1.

A weaving rotor for a series shed weaving machine with beat-up lamella for the weft thread known from the Patent Specification EP 0 137 071, where beat-up lamella arranged to follow one another in the direction of rotation of the weaving rotor are placed centrally between two beat-up lamella arranged to precede them. This arrangement has the disadvantage that the beat-up lamella have a relatively small spacing in the direction of extent of the axis of rotation of the weaving rotor so that it is difficult to reliably lay in a warp thread guided by laying-in elements between adjacent beat-up lamella. In particular in the case of a high warp thread density, there is the danger that the individual warp threads will be inserted incorrectly into the intermediate spaces between the beat-up lamella, which would lead to reediness or to weave faults.

SUMMARY OF THE INVENTION

The object of the invention is to provide a weaving rotor which overcomes the named disadvantages.

An advantage of the invention is to be seen in the fact that the distance between two beat-up lamella can be enlarged in the direction of extent of the axis of rotation of the weaving rotor so that a warp thread can be laid in between the two beat-up lamella with increased reliability. A further advantage is to be seen in the fact that the weft threads can be uniformly beat up to a cloth edge by the beat-up lamella which are arranged so as to be displaced in the direction of rotation of the weaving rotor.

BRIEF DESCRIPTION OF THE DRAWINGS

The invention will be explained in the following with reference to an exemplary embodiment. Shown are.

DESCRIPTION OF THE SPECIFIED EMBODIMENTS

Figure 1A:
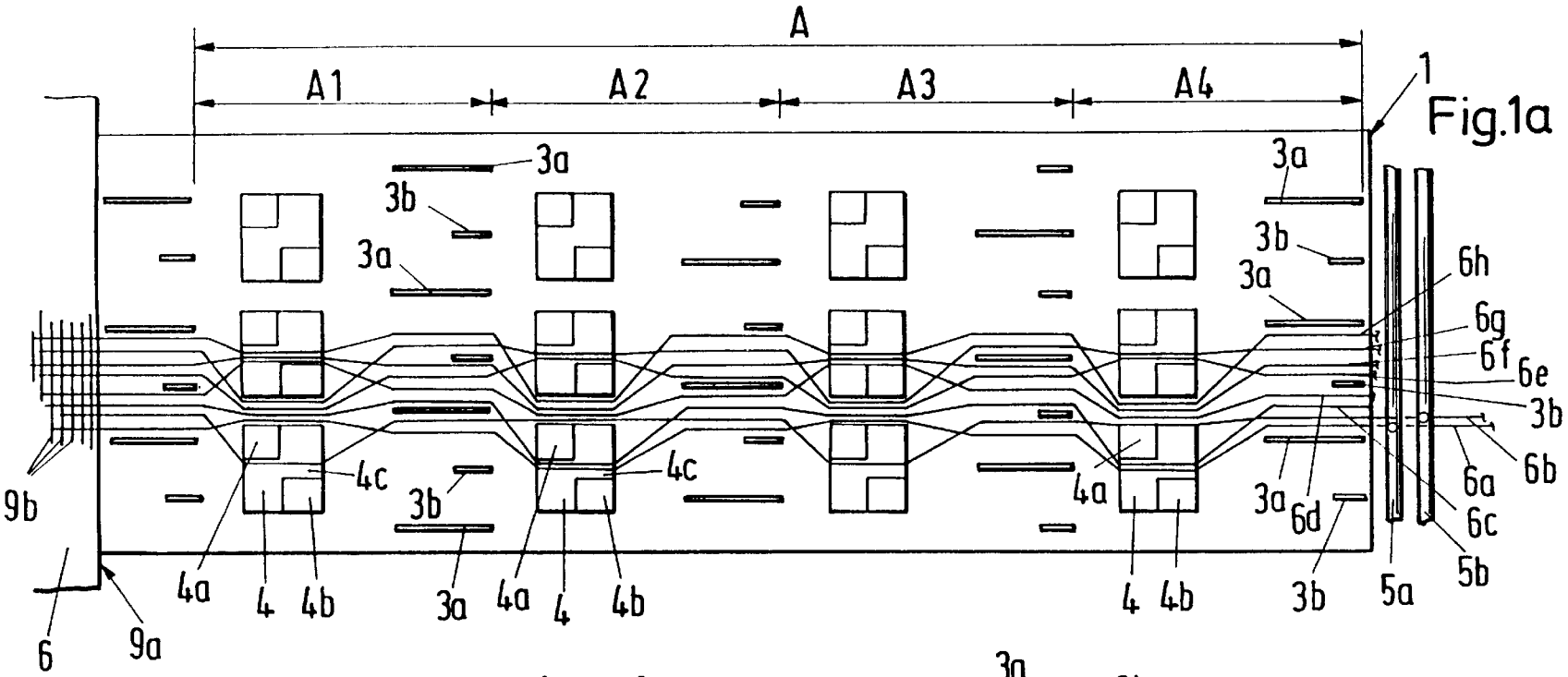
FIG. 1*a* is a plan view of a weaving rotor.
Figure 1B:
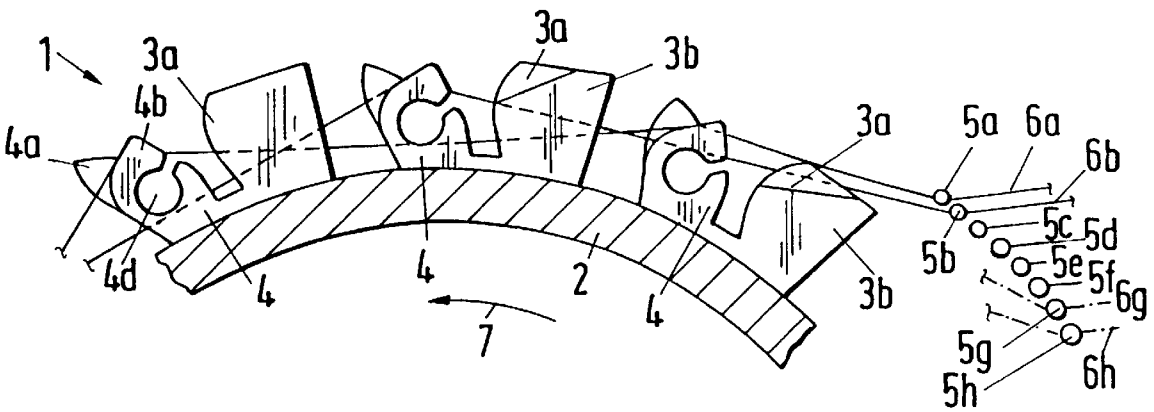
FIG. 1*b* is a side view of a weaving rotor.

FIG. 1*b* shows a cylindrical weaving rotor 1 on the surface of which are arranged shed forming shed holder elements 4 which place the warp threads 6*a*, 6*b*–6*h* extending in the direction of rotation 7 of the weaving rotor 1 into an upper shed position or a lower shed position respectively, so that a weft insertion channel 4*d* arises through which a weft thread can be inserted by means of a fluid such as air. A weft insertion channel 4*d* extends parallel to the shaft 8 of the weaving rotor 1 and extends over the entire width of the weaving rotor. Shed holder elements 4 and beat-up lamella 3*a*, 3*b* are arranged alternately in the direction of rotation 7 on the surface of the weaving rotor 1. The beat-up lamella are executed as whole beat-up lamella 3*a* or as half beat-up lamella 3*b*. The whole beat-up lamella 3*a* are designed in such a manner that they effect a beating up to the cloth edge 6*a* of a weft thread 9*b* which is completely inserted between the warp threads 6*a*–6*h* and is located directly in front of the cloth edge 9.

FIG. 1*a* shows a plan view of the surface of a cylindrical weaving rotor 1. Shed holder elements 4 which have projecting parts 4*a*, 4*b* and form a saddle surface 4*c* between them are arranged on the weaving rotor 1. The warp threads 6*a*–6*h* are laid against the surface of the weaving rotor 1 in such a manner that a warp thread 6*a*–6*h* either passes over a saddle surface 4*c* of the shed holder element 4 so that the warp thread takes on an upper shed position, or in such a manner that warp thread 6*a*–6*h* passes between two shed holder elements 4 and thereby adopts a lower shed position. In this manner a shed is formed through which a weft thread can be inserted. Laying-in elements 5*a*–5*h* serve for laying the warp threads 6*a*–6*h* into the weaving rotor. The laying-in elements 5*a*–5*h* are movable parallel to the shaft 8 of the weaving rotor 1 and position the warp threads 6*a*–6*h* in such a manner that they are laid into the weaving rotor. When laying in the warp threads 6*a*–6*h* the position of the beat-up lamella 3*a*, 3*b* is also to be taken into account in addition to the position of the shed holder elements 4. The alternating arrangement of half and whole beat-up lamella 3*a*, 3*b* in the direction of extent of the shaft 8 can advantageously be used for the laying-in procedure in that, when being laid in, a warp thread 6*a* is at first positioned by the laying-in element 5*a* in such a manner that the warp thread 6*a* reliably comes to lie between two whole beat-up lamella 3*a*. As soon as the warp thread 6*a* lies between the two whole beat-up lamella 3*a* through the weaving rotor rotating in the direction of rotation 7, the laying-in element 5*a* can be moved again in order to determine into which of the two intermediate spaces formed by the half beat-up lamella 3*b* arranged between the whole beat-up lamella 3*a* the warp thread 6*a* should be laid. During this, as shown in FIG. 1*b*, the freedom of movement of the warp thread 6*a* is limited by the whole beat-up lamella 3*a*, whereas the half beat-up lamella 3*b* does not yet limit the freedom of movement of the warp thread 6*a*. In this manner the laying-in element 5*a* can be deflected outwards in such a manner that the warp thread 6*a* lies against the whole beat-up lamella 3*a*, so that the warp thread 6*a* is reliably inserted between the two beat-up lamella 3*a*, 3*b*. A procedure of this kind for the laying in of warp threads 6*a* into the weaving rotor 1 has the advantage that even very densely arranged warp threads can be reliably laid in between adjacent beat-up lamella 3*a*, 3*b*, i.e. that a warp thread can be reliably laid in even between two adjacent beat-up lamella 3*a*, 3*b* having a small spacing. At the same time, the freedom in the choice of the time for the laying in of the warp threads is increased.

Figure 1C:
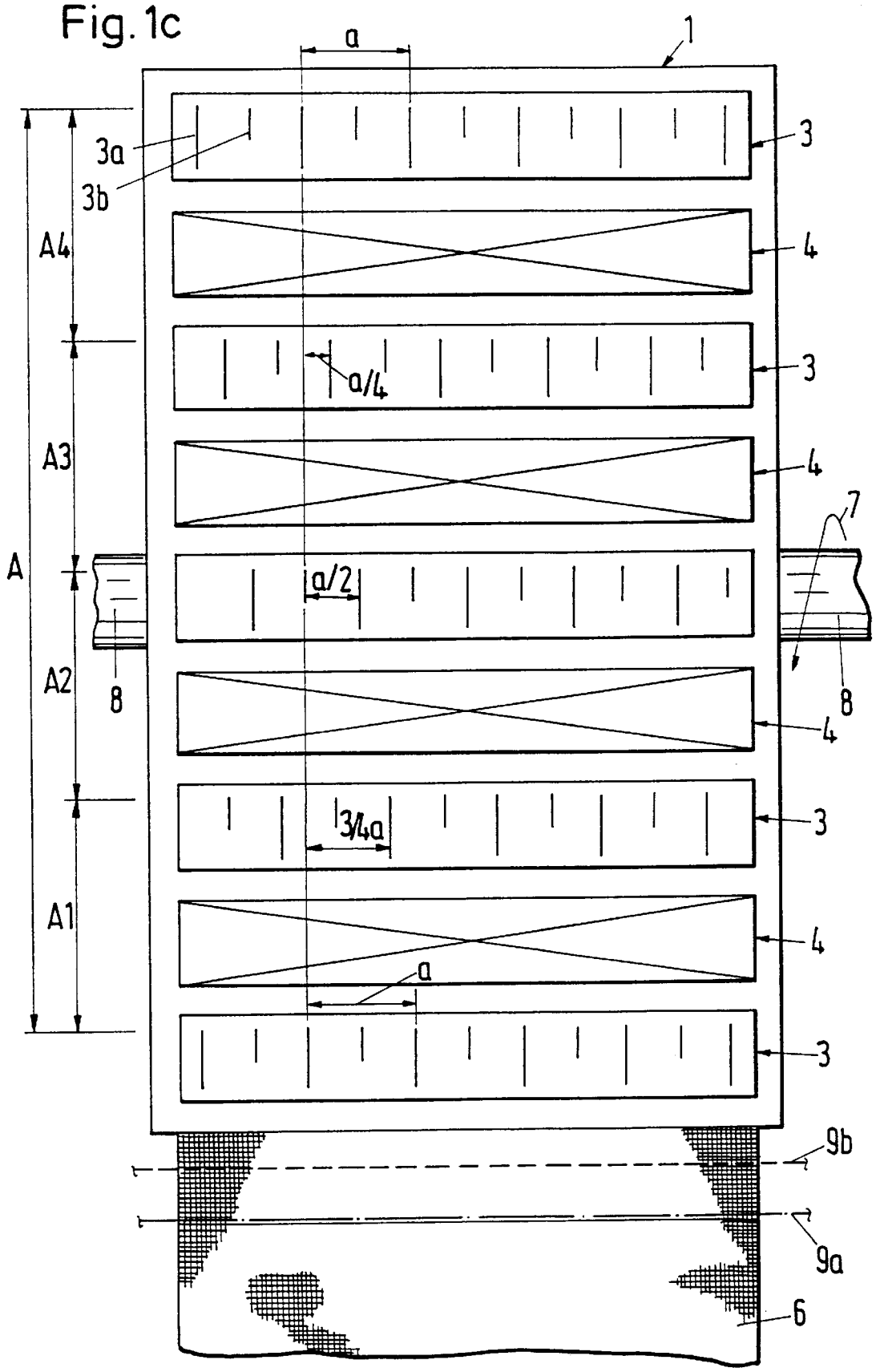
FIG. 1*c* is a further plan view of a weaving rotor.

The weaving rotor rotating in the direction of rotation 7 forwards an inserted weft thread 9*a* up to the cloth beat-up edge 9*a*, with the weft thread 9*b* being lifted out of the weft insertion channel 4*d* so that it can be beat up against the cloth edge 9*a* of the cloth 9 by the whole beat-up lamella 3*a*. In the exemplary embodiment of FIG. 1*a* and FIG. 1*c* the beat-up lamella 3*a*, 3*b* are arranged in the direction of rotation 7 of the weaving rotor 1 in such a manner that four sequential rows of beat-up lamella 3*a*, 3*b* have a spacing of a/4 in each case in the direction of extent of the shaft 8; so that after a distance A, the beat-up lamella 3*a*, 3*b* are again arranged to be aligned to the beat-up lamella 3*a*, 3*b*. The spacings A1, A2, A3, A4 between the rows of beat-up lamella 3*a*, 3*b* are made to be equally large. The combs 3 with beat-up lamella 3*a*, 3*b* which are arranged to follow one another on the surface of the weaving rotor in the direction of rotation 7 are arranged to be displaced in the direction of extent of the shaft 8 from comb 3 to comb 3. Two whole beat-up lamella 3*a* have a spacing a in the direction of extent of the shaft 8. Combs 3 which are arranged to be adjacent in the direction of rotation 7 are, as shown in FIG. 1*c*, arranged to be displaced in each case by an amount a/4 in the direction of extent of the shaft 8 so that the beat-up lamella 3*a*, 3*b* of the fifth comb are again arranged identically to those of the first comb 3. This displacement of the beat-up lamella 3*a*, 3*b*, in particular of the whole beat-up lamella 3*a*, causes the weft threads 9*b* to be beat up uniformly distributed over the width of the cloth 6 so that a uniform cloth 6 arises. If the beat-up lamella 3*a* were not arranged to be displaced in the direction of the shaft 8, then reediness (warp striations) could arise in the cloth. Without a displaced arrangement of a fourth of the distance a, four times as many beat-up lamella 3*a*, 3*b* would have to be provided for an arranged row of beat-up lamella 3*a*, 3*b* in order to obtain approximately the same beat-up quality of a weft thread against the cloth edge. The beat-up lamella 3*a*, 3*b* can also be arranged so as to be displaced in the direction of extent of the shaft 8 by an amount different from a/4, in particular by a rational fraction of a.

What is claimed is:

1. A weaving rotor for a series shed weaving machine, the weaving rotor comprising:

a shaft having an axial direction; and a plurality of beat-up lamella which are arranged on a surface of the weaving rotor and travel in a direction of rotation of the shaft, wherein two beat-up lamella which are arranged alternately in the axial direction of the shaft have a spacing (a), wherein the beat-up lamella which are arranged on the weaving rotor to follow one another in the direction of rotation are spaced regularly in the axial direction of the shaft and are further arranged so as to be displaced in the axial direction of the shaft by a distance which is a rational fraction of the spacing (a) in the axial direction of the shaft.

2. A weaving rotor in accordance with claim 1 wherein the beat-up lamella which are arranged on the weaving rotor to follow one another in the direction of rotation have a spacing of one-quarter of the spacing (a) in the axial direction of the shaft.

3. A weaving rotor in accordance with claim 1 wherein a whole beat-up lamella and a half beat-up lamella are arranged alternately in the axial direction of the shaft.

4. A series shed weaving machine comprising a weaving rotor which includes a shaft having an axial direction; and a plurality of beat-up lamella which are arranged on a surface of the weaving rotor and travel in a direction of rotation of the shaft, wherein two beat-up lamella which are arranged alternately in the axial direction of the shaft have a spacing (a), wherein the beat-up lamella which are arranged on the weaving rotor to follow one another in the direction of rotation are spaced regularly in the axial direction of the shaft and are further arranged so as to be displaced in the axial direction of the shaft by a distance which is a rational fraction of the spacing (a) in the axial direction of the shaft.

* * * * *